United States Patent [19]

Dashnier et al.

[11] 4,422,584

[45] Dec. 27, 1983

[54] TOILET PAPER DISPENSER WITH SWINGING MANDRELS

[75] Inventors: Merwin J. Dashnier; James A. Diring; Donald G. Krueger, all of Green Bay, Wis.

[73] Assignee: Wisconsin Tissue Mills, Inc., Menasha, Wis.

[21] Appl. No.: 309,946

[22] Filed: Oct. 9, 1981

[51] Int. Cl.[3] ..... B65H 19/04

[52] U.S. Cl. ..... 242/55.3; 242/55.53

[58] Field of Search ..... 242/55.3, 55.53; 312/38, 39, 40; 225/46, 47, 76; D6/97

[56] References Cited

U.S. PATENT DOCUMENTS

| | | | |
|---|---|---|---|
| 2,550,790 | 5/1951 | Engel | 242/55.53 |
| 3,650,487 | 3/1972 | Bahnsen | 242/55.3 |

*Primary Examiner*—Leonard D. Christian

[57] ABSTRACT

A two roll tissue dispenser includes mandrels, each supported by an arm having a sleeve portion pivoted on a common axis. Projections on the adjacent ends of the sleeves inter-engage to cause movement of the arm which supports the mandrel in an upper storage position to a lower dispensing position when the mandrel for the lower roll is pushed rearwardly from the dispensing position to an exhausted spool position.

4 Claims, 6 Drawing Figures

TOILET PAPER DISPENSER WITH SWINGING MANDRELS

BACKGROUND OF THE INVENTION

In public places it is desirable to have two roll paper tissue dispensers so that one roll can be switched into the dispensing position when the other roll is exhausted. With dispensers of this type, such as illustrated in U.S. Pat. No. 3,650,487, it is also desirable to maintain the second roll in a storage position without access until the first roll is completely consumed. Preferably with dispensers of this type the manipulation of the rolls from a storage to access dispensing position is easily accomplished by the public by a simple manual manipulation.

SUMMARY OF THE INVENTION

The invention provides a dispenser which accomplishes the foregoing objectives. A pair of roll supporting mandrels are carried by arms which are commonly pivoted to the same shaft which forms a pivotal axis. Sleeve portions carried by the shaft and connected to the arm have axially projecting dogs or fingers which inter-engage during swinging movement of the lower mandrel from the dispensing position to an exhausted roll position. The interconnection of axially extending dogs enables the user to easily release the latch which maintains the upper roll in the storage position during use of the lower roll by pushing the exhausted spool and mandrel rearwardly. Release of the latch causes the upper stored roll to fall by gravity to the dispensing position in the housing access opening.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
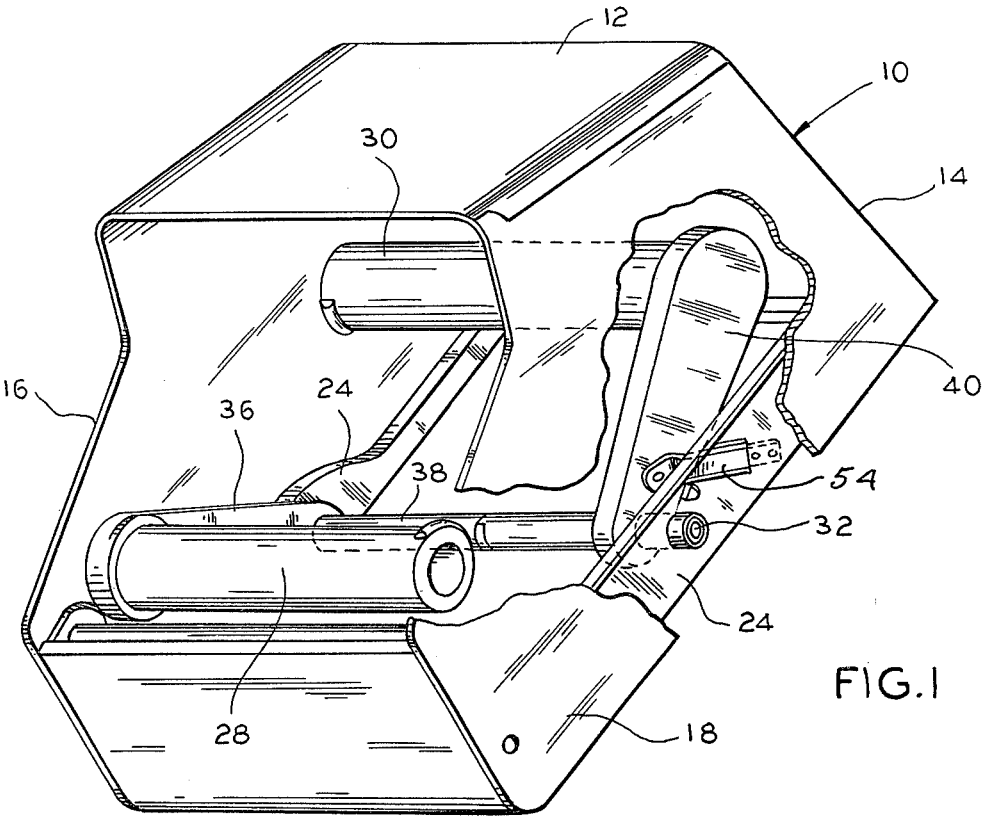
FIG. 1 is a perspective view with parts broken away of a dispenser in accordance with the invention.

In the drawings, FIG. 1 shows a dispenser 10 having a front wall 12, top wall 14 and side walls 16 and 18. The tissue rolls are supported on a mandrel assembly 20 (FIG. 2) which includes a back cover 22 with upstanding flanges 24 on the side edges of the cover 22. The assembly includes a first or lower mandrel 28 and a second or upper mandrel 30.

Figure 6:
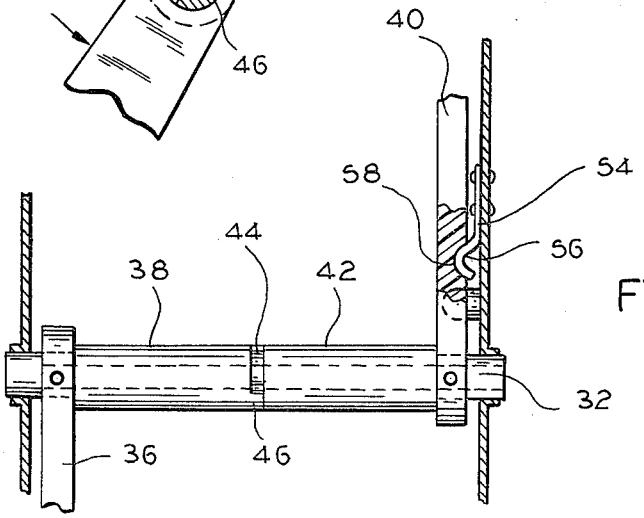
FIG. 6 is a front view of the support arms for the mandrel and the latch mechanism for holding the upper mandrel arm in the storage position.

The mandrel assembly also includes means for supporting the mandrels for movement between first and second positions. In the disclosed construction, the means includes a pivotal axis 32 which can be in the form of a rod or pin and an arm 36 for the mandrel 28 which has an integral sleeve portion 38 (FIG. 6) journaled on the pin 32. The mandrel 30 has a support arm 40 with an integral sleeve portion 42 also supported on the pin 32.

In accordance with the invention, means are provided for connecting the support arms 36 and 40 to cause co-active movement of the support arm 40 in response to manual movement of the support arm 36 when arm 36 is shifted to the exhausted spool position. In the disclosed construction the means comprises axially projecting teeth or dogs 44 on sleeve 42 and a projecting dog 46 on sleeve 38. The dogs 44, 46 cause movement of the upper arm in response to movement of the lower arm 36, as subsequently described herein.

Figure 2:
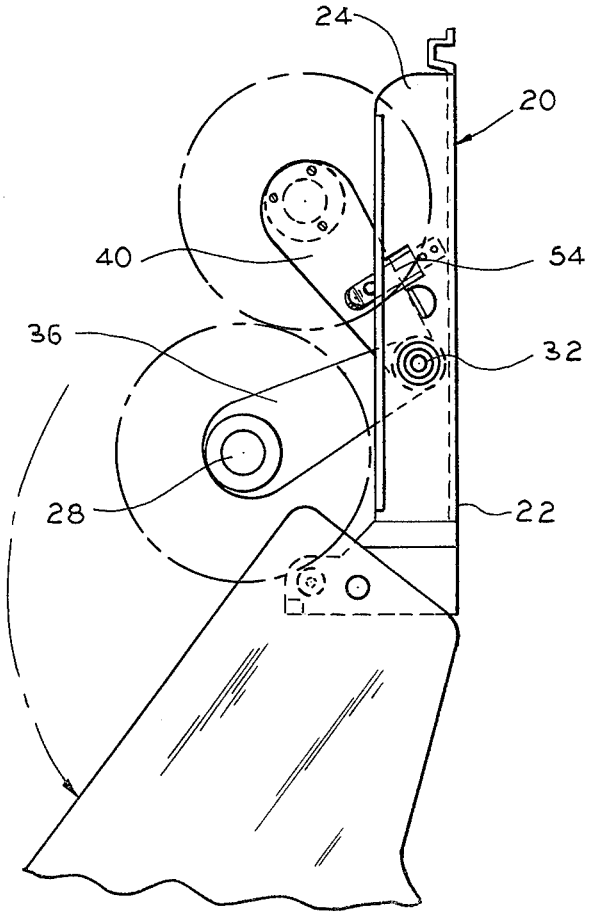
FIG. 2 is a side elevational view of the dispenser shown in FIG. 1 with the cover open.

In FIG. 1 the arm 40 is shown in a protected storage position above the dispensing opening 48. In this position access to the roll 50 is difficult. The arm 40 is maintained in the storage position by a latch 54 which can be in the form of a detent with a spring urged loop 56 engageable in a recess 58 (FIG. 6) in arm 40. A stop tab 60 (FIG. 4) insures positive engagement of the latch as the arm 40 is moved upwardly to the storage position when the rolls are loaded in the dispenser. FIG. 2 illustrates the exposed position of the mandrels with the mandrel assembly displaced outwardly from the side walls of the housing to facilitate loading.

Figure 3:
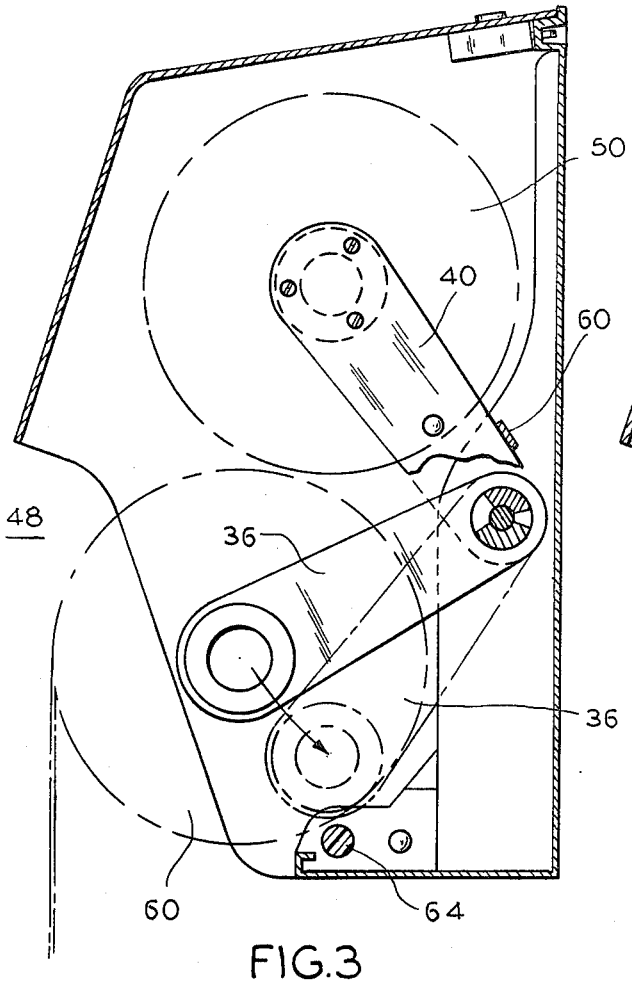
FIG. 3 is a side view with parts removed of the dispenser showing the rolls in a first position.
Figure 5:
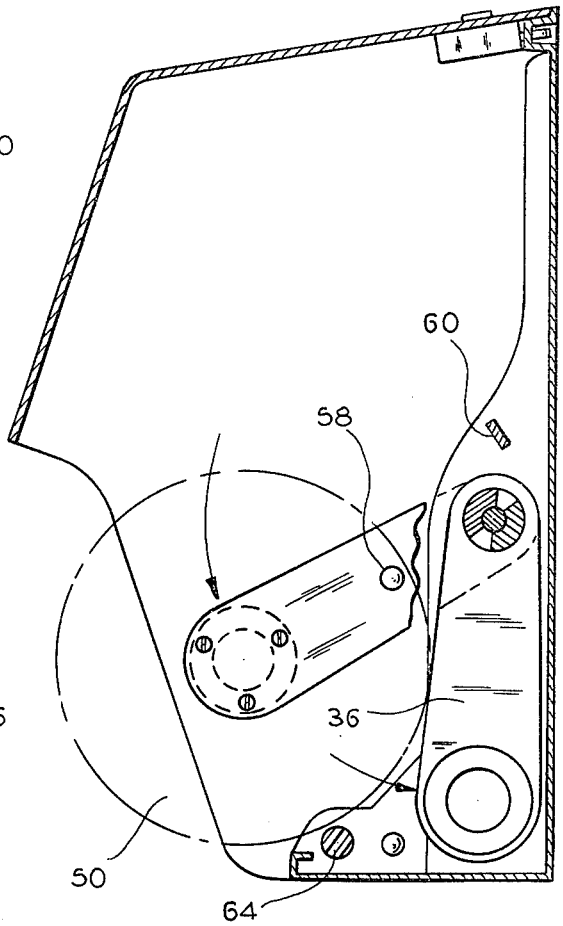
FIG. 5 is a view similar to FIG. 3 showing the rolls in a second position with the upper roll in the dispensing position and the lower arm in the exhausted spool storage position.

Referring again to FIG. 3, the lower roll 60 is maintained in the position illustrated in FIG. 3, with the arm 36 in the full line position until the tissue or paper is consumed by a cross rod 64 which is supported by the side walls of the mandrel assembly 20. Cross rod 64 can be loosely supported so that it can rotate to facilitate withdrawal of paper from the roll 60. Only after the paper on roll 60 is almost completely exhausted is there sufficient clearance so that the arm 36 can swing to the exhausted core position shown in dotted lines in FIG. 3 and in full lines in FIG. 5.

Figure 4:
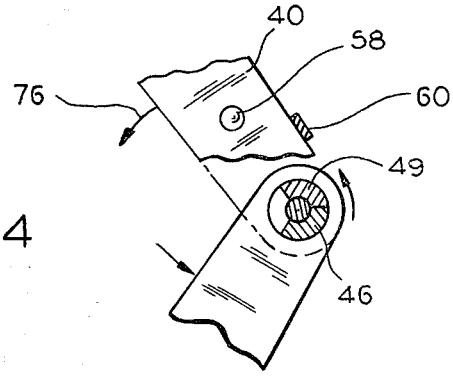
FIG. 4 is a fragmentary view showing the action of the dogs that cause movement of the upper roll to the dispensing position.

As the arm 36 is swung to the exhausted core position (FIG. 5) by manual manipulation by the user of the dispenser, the inter-engagement of the dogs 44 and 46, as illustrated in FIG. 4, causes the motion illustrated by the arrows in FIG. 4, with dog 46 urging the arm 40 forwardly in the direction of arrow 76 to release the arm 40 from the latch 56 to cause arm 40 and the roll 50 to swing by gravity until the cross rod 64 is engaged.

The dispenser is easily loaded when the mandrel assembly is displaced outwardly from the housing because of the shallow mandrel assembly walls which easily permit axial loading of the tissue rolls on the cantilevered mandrels.

We claim:

1. In a toilet paper dispenser having wall means defining a housing and a dispensing opening, the improvement comprising:

(1) first and second mandrels;

(2) support means for supporting the mandrels from a common pivot; and (3) engagement means on the support means to cause movement of the second mandrel from a storage position to a free swinging position so that the second mandrel can swing about the pivot by gravity to a lower dispensing position upon movement of the first mandrel from a dispensing position to an exhausted core storage position, the engagement means not being engaged when the second mandrel is in its free swinging position.

2. The improvement of claim 1 wherein:

the support means comprises an arm for each mandrel and a sleeve connected to each arm for rotatably supporting said arms on the pivot; and the engagement means comprises axial projections on adjacent ends of the sleeves which are engageable to cause movement of the arm for the second mandrel in response to movement of the arm for the first mandrel during shifting thereof from its dispensing position to its storage position.

3. The improvement of claim 1 wherein:

the housing comprises (a) a cover including a front wall, top wall and side walls, and (b) a rear wall having upstanding side flanges;

the side walls of the cover are pivotally connected to the upstanding side flanges of the rear wall;

the common pivot comprises a rod connected between the side flanges of the rear wall, and the first and second mandrels and the support means for supporting the mandrels are carried by the rod; and fresh rolls of toilet paper are loaded axially onto the mandrels over the side flanges of the rear wall upon displacement of the cover therefrom.

4. The improvement of claim 2 including latch means to hold the second mandrel in its storage position comprising a spring element secured to the housing and engageable with a recess in the arm for the second mandrel, the latch means being overcome by manual manipulation of the first mandrel for movement thereof from its dispensing position.

* * * * *